US010213070B2

(12) United States Patent
Osborne, Jr.

(10) Patent No.: US 10,213,070 B2
(45) Date of Patent: Feb. 26, 2019

(54) CARRIAGE ASSEMBLY FOR SEQUENTIAL PAPER PRODUCTS DISPENSERS

(75) Inventor: Charles Agnew Osborne, Jr., Cumming, GA (US)

(73) Assignee: SOLARIS PAPER, INC., Alpharetta, GA (US)

( * ) Notice: Subject to any disclaimer, the term of this patent is extended or adjusted under 35 U.S.C. 154(b) by 628 days.

(21) Appl. No.: 13/991,404

(22) PCT Filed: Dec. 5, 2011

(86) PCT No.: PCT/US2011/063325

§ 371 (c)(1), (2), (4) Date: Aug. 15, 2013

(87) PCT Pub. No.: WO2012/075504

PCT Pub. Date: Jun. 7, 2012

(65) Prior Publication Data

US 2013/0320130 A1 Dec. 5, 2013

Related U.S. Application Data

(60) Provisional application No. 61/419,430, filed on Dec. 3, 2010.

(51) Int. Cl.

| | |
|---|---|
| ***A47K 10/38*** | (2006.01) |
| ***A47K 10/22*** | (2006.01) |
| *A47K 10/32* | (2006.01) |

(52) U.S. Cl.

CPC ..... *A47K 10/38* (2013.01); *A47K 10/22* (2013.01); *A47K 10/3845* (2013.01); *A47K 2010/3253* (2013.01)

(58) Field of Classification Search

CPC .... A47K 2010/3253; A47K 2010/3233; A47K 2010/3681; A47K 10/3687; A47K 10/38; A47K 10/3253; A47K 10/22; A47K 10/34; A47K 10/36; A47K 2010/3675; A47K 10/3845

USPC ..... 242/560, 560.1, 560.2, 560.3, 561

See application file for complete search history.

(56) References Cited

U.S. PATENT DOCUMENTS

| | | | |
|---|---|---|---|
| 3,387,902 | A | 6/1968 | Perrin |
| 4,143,827 | A | 3/1979 | Tucker |
| 5,370,336 | A | 12/1994 | Whittington |
| 6,386,479 | B1 | 5/2002 | Lewis |
| 6,752,349 | B2 | 6/2004 | Moody |
| 2003/0146337 | A1 | 8/2003 | Moody |
| 2008/0099595 | A1 | 5/2008 | Lewis |
| 2012/0104143 | A1 | 5/2012 | Phelps |

FOREIGN PATENT DOCUMENTS

AT 506716 A1 * 11/2009 ..... A47K 10/3687

OTHER PUBLICATIONS

Translation of AT 506716 A1.*

PCT Search Report and Written Opinion dated Apr. 19, 2012 for PCT/US11/63325 entitled Carriage Assembly for Sequential Paper Products Dispensers filed Dec. 5, 2011.

* cited by examiner

*Primary Examiner* — Michael R Mansen
*Assistant Examiner* — Nathaniel L Adams
(74) *Attorney, Agent, or Firm* — Fish IP Law, LLP

(57) ABSTRACT

A carriage assembly for a sequential roll paper product dispenser is presented. The carriage assembly is placed within tracks of the dispenser and allows for automatic advancement of roll paper products.

20 Claims, 8 Drawing Sheets

FIG. 9a
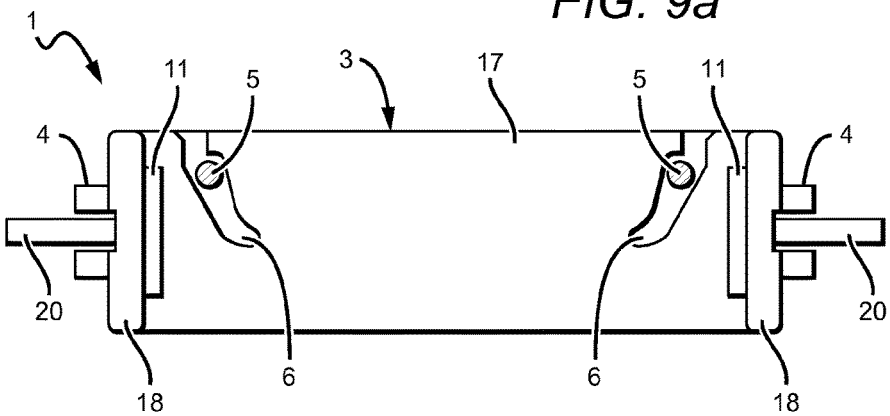
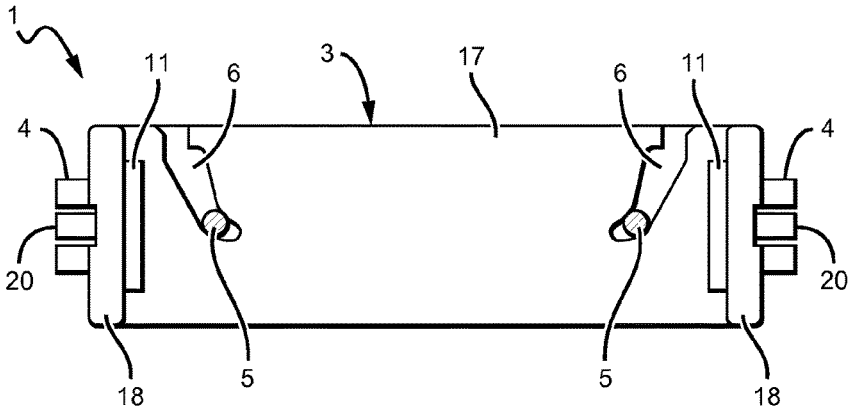
FIG. 9b
FIG. 11
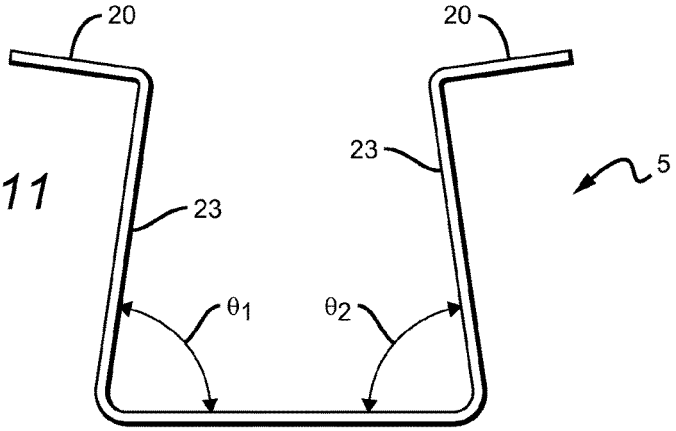

CARRIAGE ASSEMBLY FOR SEQUENTIAL PAPER PRODUCTS DISPENSERS

This application claims the benefit of priority to provisional application Ser. No. 61/419,430 filed on Dec. 3, 2010. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention relates to sequential dispensers for dispensing multiple rolls of paper product.

BACKGROUND

Sequential dispensers for dispensing multiple rolls of paper product (e.g., paper towel dispensers, toilet paper dispensers) are commonly used in commercial and institutional settings. Sequential dispensers advantageously decrease the frequency that the dispenser needs to be replenished since the dispenser holds multiple rolls of paper product at once. With sequential dispensers it is especially desirable to include an automatic advancing mechanism for moving a reserve roll of paper product into position once a primary roll has been depleted. In this manner, the sequential dispenser ensures that each roll is completely used before the reserve roll can be accessed.

Several embodiments of automatic advancing mechanisms for sequential dispensers are known. Unfortunately, all known advancing mechanisms are overly complex and very limited in application. For example, some advancing mechanisms utilize multiple moving parts (e.g., pivoting sleeves and springs) and are limited to use with split-core roll paper products (i.e., the roll of paper product is wrapped around a cylindrical structure made of two separable parts). Other advancing mechanisms are limited to use with coreless paper products.

Thus, while prior art dispensers have incorporated automatic advancing mechanisms for sequential dispensers, it has yet to be appreciated that an automatic advancing mechanism (e.g., a carriage assembly) for a sequential roll paper product dispenser can have a simple design and can be used with core, coreless, reduced-core, and solid-core rolls of paper product.

Thus, there is still a need for improved carriage assemblies for sequential dispensers.

SUMMARY OF THE INVENTION

The inventive subject matter provides apparatus, systems, and methods in which a carriage assembly in a sequential roll paper product dispenser automatically advances once a roll of paper product is depleted. The carriage assembly includes a frame rotatably coupled with a wire frame assembly. The frame has spindle retainers for releasably engaging at least two spindles. The spindles fit into the center aperture of rolls of paper products and provide a means for rotatably coupling the rolls of paper product to the frame. The frame also includes several protrusions that fit into tracks within the dispenser, thus allowing the carriage assembly to move within the dispenser (i.e., along the tracks). In addition, the frame has a wire frame guide, which comprises two slots within a wall of the frame. The slots are spaced apart in a substantially non-parallel fashion such that the wire frame assembly is biased to rotate inwardly when the wire frame is disposed in the wire frame guide. Furthermore, portions of the wire frame assembly are configured to extend outwardly from the frame when the wire frame assembly is disposed in the wire frame guide and rotated outwardly from the frame. In this manner, loading a roll of paper product into the carriage assembly causes those portions of the wire frame assembly to extend outward and engage a catch. The catch is disengaged when the roll of paper product is depleted.

In some embodiments, the frame is substantially symmetrical, thus simplifying the procedure for loading the carriage assembly into a dispenser.

In other aspects of some embodiments, the frame and/or spindles of the carriage assembly are configured to receive all kinds of rolls of paper products, including coreless, solid-core, reduced-core, and cored. As used herein, "solid-core" means a roll of product that substantially lacks a center aperture. As used herein, "cored" means a roll that has a center member around which the paper product has been wound (e.g., the cardboard cylindrical core in household toilet paper rolls) whereas "coreless" means a roll of product having no separate core member. As used herein, "reduced-core" means a roll of product that has a core diameter substantially smaller than a standard or common core diameter (e.g., 1½ inches for residential-use toilet paper rolls).

In yet other aspects of some embodiments, the wire frame assembly has two ends that fit through, and rotatably couple with, two holes on the frame. The two ends are further configured to expand into and engage a catch when the wire frame assembly is rotated outwardly from the frame. The material of the wire frame assembly and the shape of the wire frame guide slots are configured such that the wire frame assembly ends can expand and contract without permanent deformation of the wire frame assembly.

Various objects, features, aspects and advantages of the inventive subject matter will become more apparent from the following detailed description, along with the accompanying drawing figures in which like numerals represent like components.

BRIEF DESCRIPTION OF THE DRAWING

FIG. 9*a* is a bottom view of a carriage assembly showing the wire frame guide tracks and the wire frame assembly ends in a locking position.

FIG. 9*b* is a bottom view of a carriage assembly showing the wire frame guide tracks and the wire frame assembly ends in an unlocked position.

FIG. 11 is a front section view of a wire frame assembly.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

It should be noted that during the discussion of the different figures, that one skilled in the art could vary the design based on current manufacturing technology or materials and still stay within the spirit and scope of the present invention.

Figure 1:
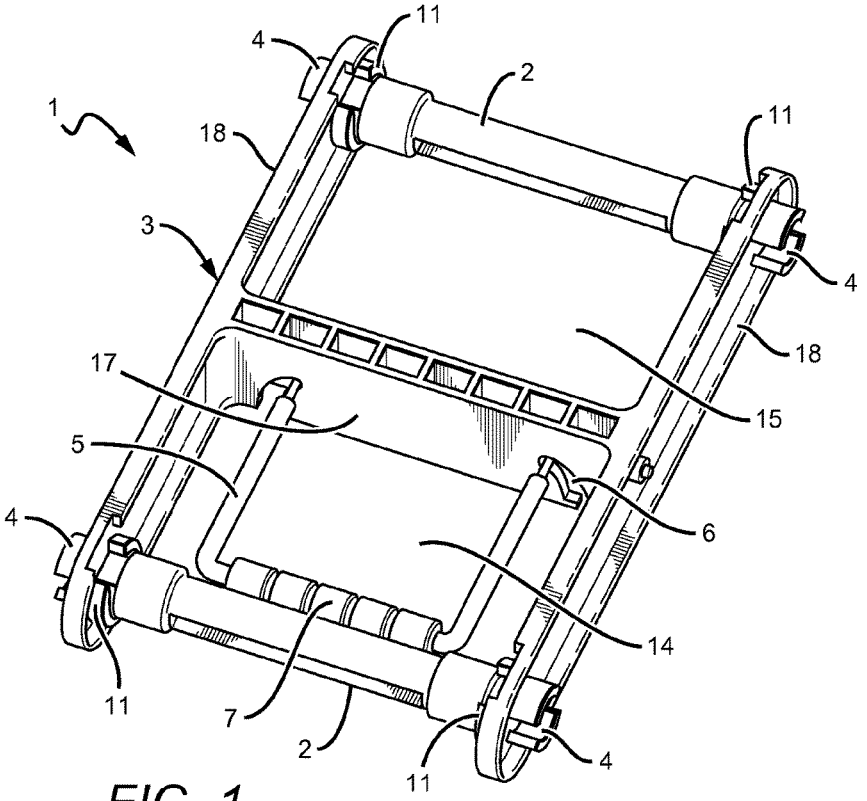
FIG. 1 is a perspective view of the carriage assembly shown without a roll of paper product.

FIG. 1 is a perspective view of carriage assembly 1 shown without roll paper products 10 (see FIG. 3), showing the lower dispensing position 14 and upper dispensing position 15, each position containing a spindle 2. Each spindle 2 is held in position between vertical members 18 of carriage frame 3 via spindle retainers 11. Vertical members 18 are spaced apart by horizontal cross member 17, which contains the wire frame guide slots 6. A wire frame assembly 5 is disposed in wire frame guide slots 6. Wire frame assembly 5 has wire frame rollers 7 for decreasing friction between roll paper products 10 and assembly 5.

Protrusions 4 are positioned on the outside of carriage frame 3 and are configured to engage guide tracks 9 of dispenser rear housing 8 (see FIG. 2), thus allowing carriage assembly 1 to move vertically within dispenser rear housing 8. Wire frame assembly 5 determines the position of carriage assembly 1 within dispenser rear housing 8. Specifically, the position of assembly 1 with respect to housing 8 determines whether roll paper products 10 (shown in FIG. 4) will be dispensed from lower dispensing position 14 or upper dispensing position 15.

Figure 2:
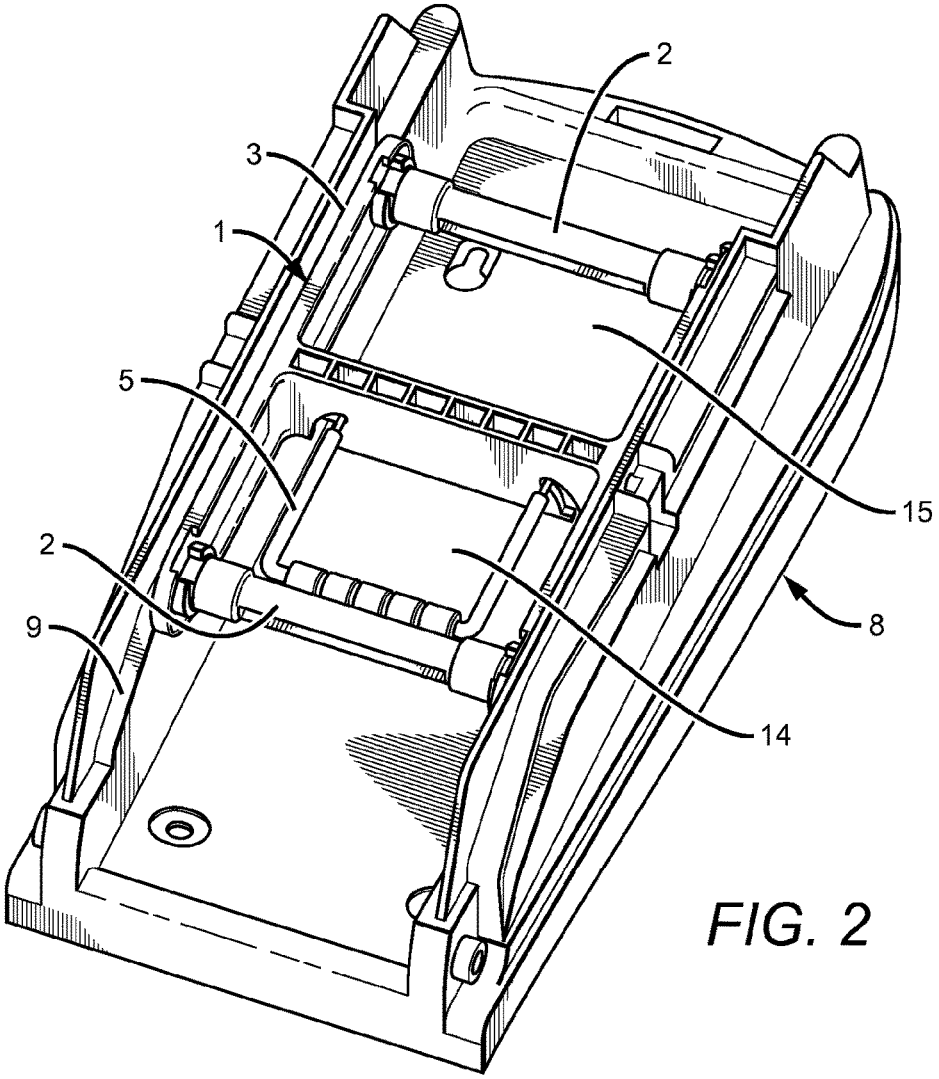
FIG. 2 is a perspective of the carriage assembly of FIG. 1 loaded into a back portion of a dispenser.

FIG. 2 is a perspective view showing the dispenser rear housing 8 with carriage assembly 1 positioned within guide tracks 9, without roll paper products 10 loaded. Carriage assembly 1 is inserted into guide tracks 9 from the top of dispenser rear housing 8, with lower dispensing position 14 being loaded into guide tracks 9 first.

Figure 3:
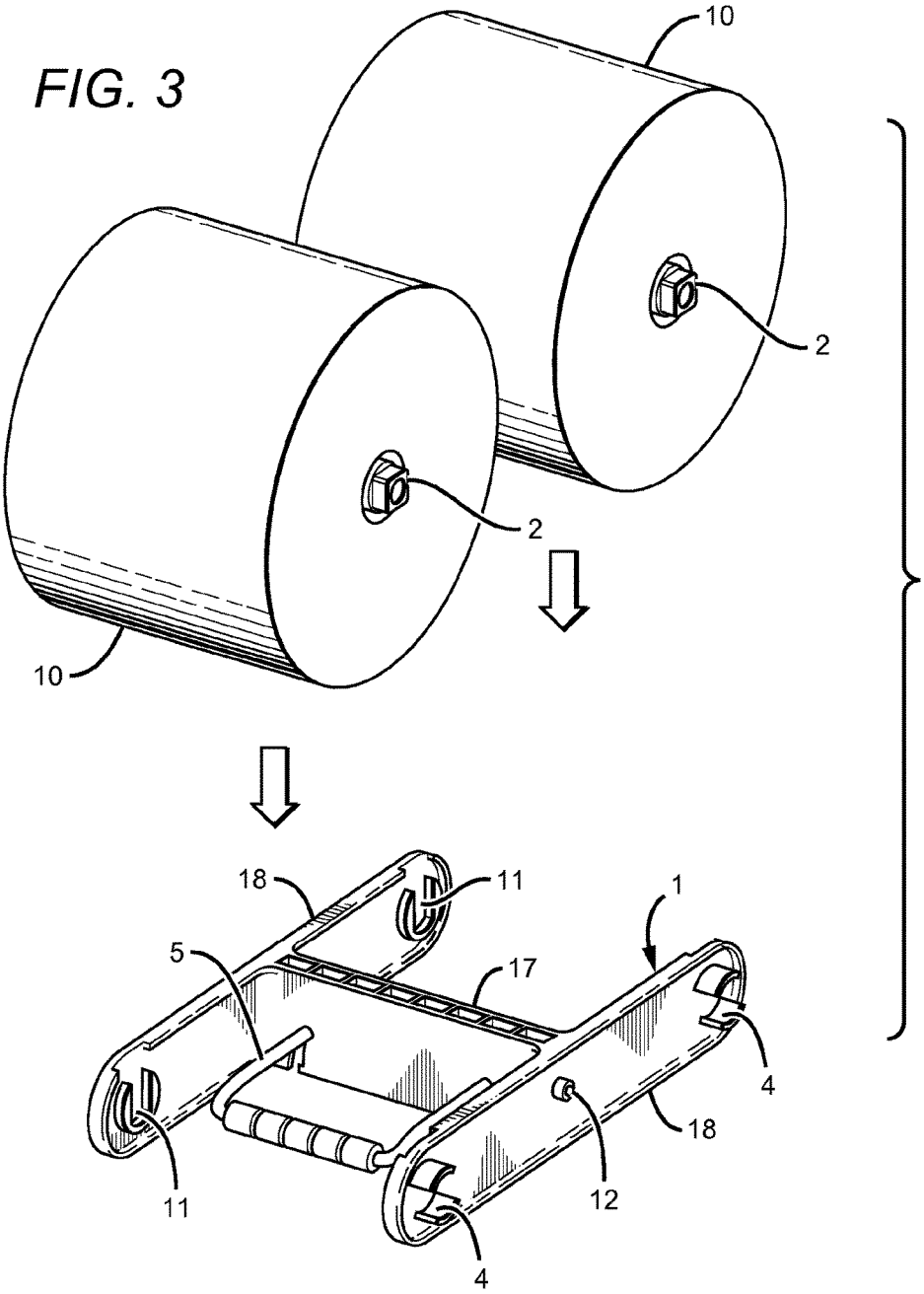
FIG. 3 is a perspective view of the carriage assembly of FIG. 1, with the spindles inserted into the center apertures of two rolls of paper product and ready to be loaded.

FIG. 3 is a perspective view of the carriage assembly 1 showing roll paper products 10 with spindles 2 inserted into the center aperture of the roll paper products 10 and ready to be loaded into carriage assembly 1. The ends of spindle 2 are configured to releasably engage spindle retainers 11 on frame 3. The horizontal distance between opposing spindle retainers 11 is equal to or less than the overall length of the spindle 2. This allows for proper retention of spindles 2 within carriage frame 3 during the dispensing of roll paper products 10. To load roll paper products 10 into frame 3, one end of spindle 2 is positioned on one of the spindle retainers 11. The axially opposite spindle retainers 11 is pushed out of position by applying outward pressure to vertical members 18. Spindle 2 is then brought to a horizontal position and the pressure is released from vertical members 18 allowing spindle retainers 11 to capture the end of spindle 2. As the roll paper products 10 is positioned in carriage assembly 1, wire frame assembly 5 is rotated out of it neutral position, forcing wire frame assembly protrusion 20 (shown in FIGS. 9*a* and 9*b*) horizontally outward into locking position. This step is repeated for the upper dispensing position 15.

Those of skill in the art will appreciate that numerous configurations for spindles and spindle retainers can be used consistently with the inventive subject matter disclosed herein. In other embodiments, spindle 2 has an internal spring and can contract and expand into retainers 11. In such embodiments, vertical members 18 of frame 3 do not need to be flexed in order to load roll paper products 10 and can be made of a rigid material.

FIG. 3 also shows frame protrusion/opening 12, comprising two protruding holes in vertical members 18. The ends of wire frame assembly 5 pass through frame protrusion/openings 12, thus allowing wire assembly 5 to rotatably couple with frame 3. Rotatable couplings are well known and those of skill in the art will appreciate that many different configurations of rotatable couplings can be used consistently with the inventive concepts disclosed herein. However, the rotatable coupling disclosed in FIG. 3 advantageously provides a simple coupling means and reduces the number of parts required.

Figure 4:
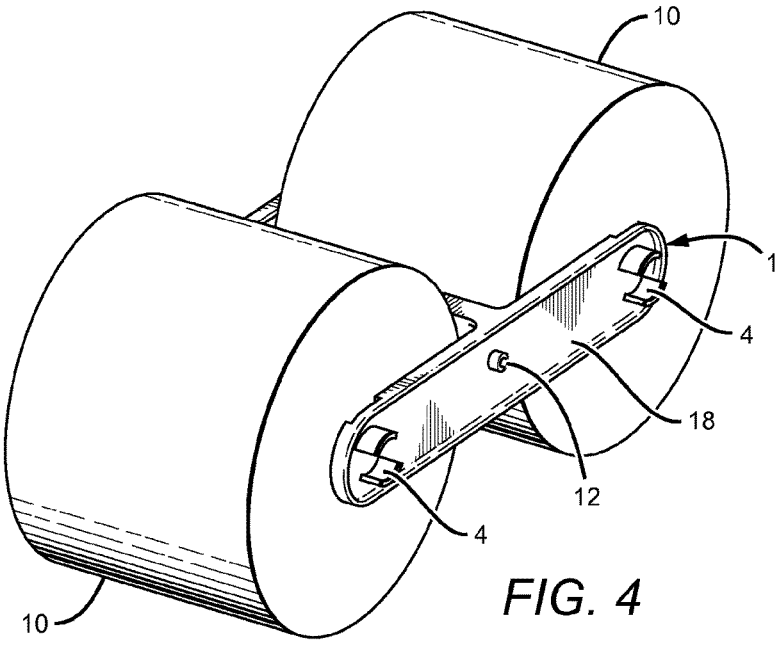
FIG. 4 is a perspective view of the carriage assembly of FIG. 1 with two rolls of paper product loaded and ready for inserting into a dispenser.
Figure 6:
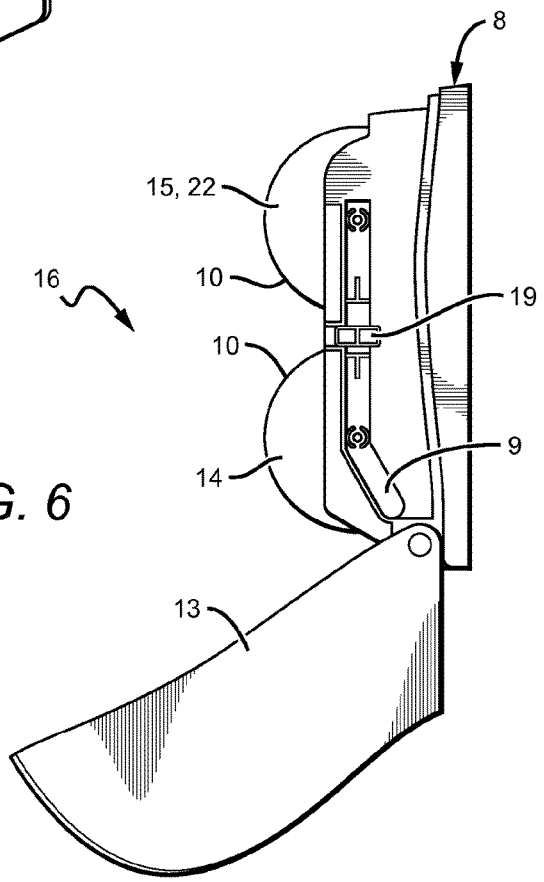
FIG. 6 is a side view of a dispenser shown with the front cover in the open position and a carriage assembly loaded with two rolls of paper product and positioned within the dispenser's tracks.

FIG. 4 is a perspective view of the carriage assembly 1 showing roll paper products 10 loaded and ready for inserting into the dispenser rear housing 8 via guide tracks 9 (as shown in FIG. 6)

Figure 5:
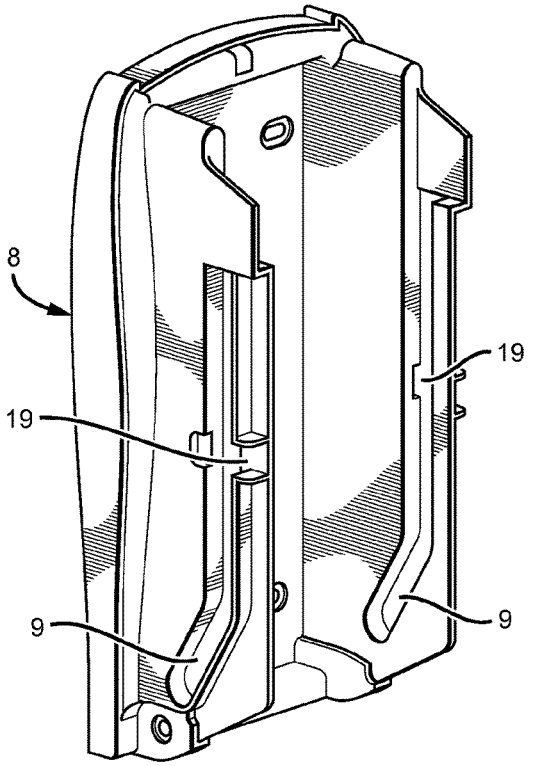
FIG. 5 is a perspective view of the back of a dispenser, showing the recessed tracks used to guide a carriage assembly.

FIG. 5 is a perspective view of dispenser rear housing 8 showing guide tracks 9 used to guide carriage assembly 1 loaded with roll paper products 10. Also shown in this view are rear housing locking stops 19 used to hold carriage assembly 1 in lower dispensing position 14 (shown in FIG. 7) to allow the dispensing of roll paper product from lower dispensing position 14.

FIG. 6 is a side view of a dispenser assembly 16 shown with a front cover 13 in the open position and carriage assembly 1 loaded with roll paper products 10 and positioned within the guide tracks 9. Lower dispensing position 14 is held in a dispensing position by rear housing locking catch 19. The roll paper products 10 held in the upper dispensing position 15 is held in reserve position 22 and will be hidden from view when front cover 13 is closed (as shown in FIG. 7).

Figure 7:
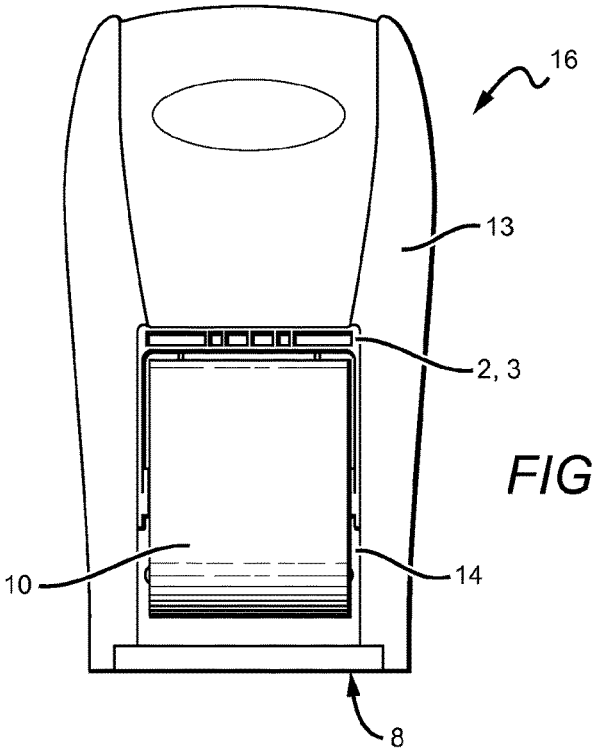
FIG. 7 is a front view of the dispenser of FIG. 6 with the front cover in the closed position, the carriage assembly and paper product loaded, and in the locked dispensing position

FIG. 7 is a front view of the dispenser assembly 16 with the front cover 13 in the closed position. Carriage assembly 1 is loaded with roll paper products 10 and has been positioned within guide tracks 9 of dispenser rear housing 8. Lower dispensing position 14 is positioned at the opening of front cover 13 and is in a dispensing position. The roll paper products 10 held in the upper dispensing position 15 is held in reserve position 22 hidden from view behind front cover 13.

Figure 8:
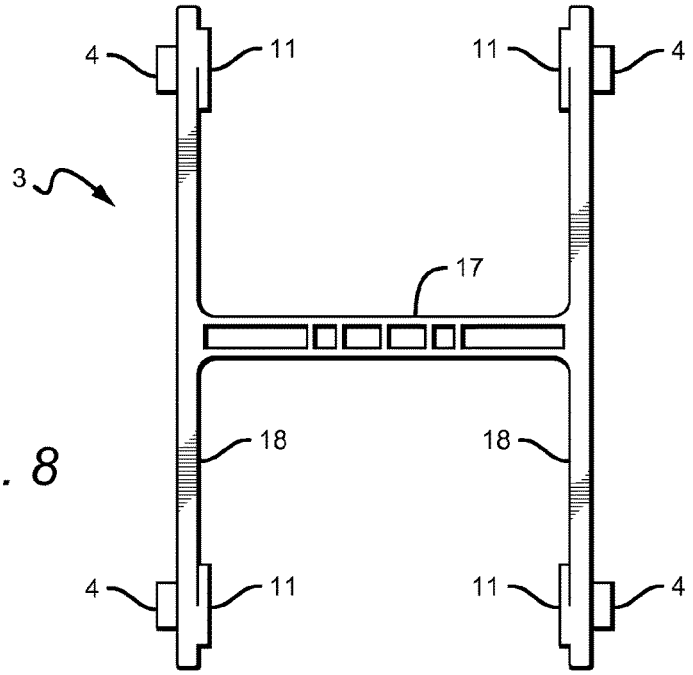
FIG. 8 is a front view of a carriage assembly showing the guide track protrusions.

FIG. 8 is a front view of the carriage frame 3 showing protrusions 4, spindle retainers 11, and vertical members 18 held apart by horizontal cross member 17. It should be noted that one of skill in the art could configure spindle retainers 11 and spindle 2 to hold and retain a roll of coreless, solid-core, or reduced-core paper product, without departing from the inventive subject matter. For example, spindle retainers 11 could be configured to releasably engage with the reduced-core spindles described in co-pending U.S. patent application Ser. No. 13/288,257, which is incorporated herein by reference. In some embodiments, the need for spindle 2 could even be eliminated by configuring retainers 11 to directly engage a solid-core or center aperture of a roll of paper product.

Figure 10A:
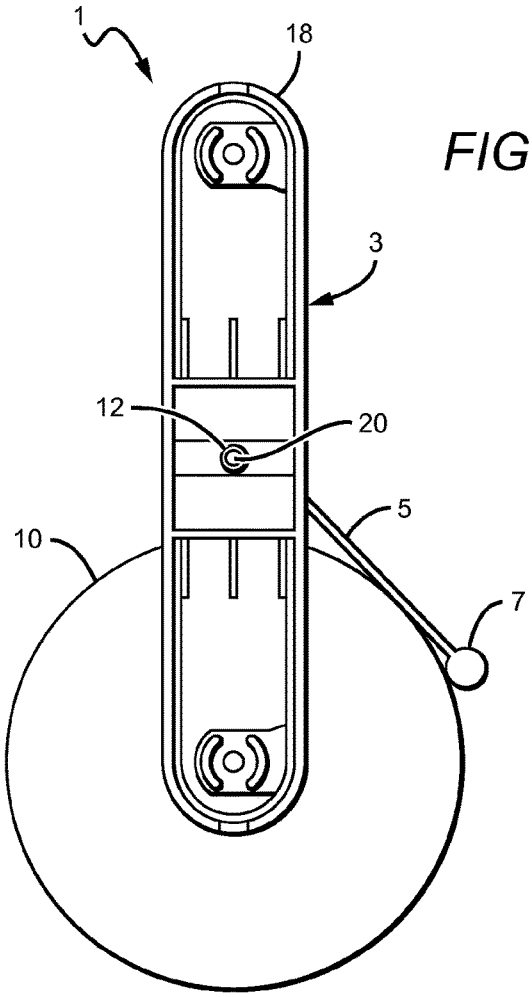
FIG. 10*a* is a side view of a carriage assembly with a full roll of paper product loaded.

FIG. 9*a* is a bottom view of the carriage assembly 1 showing the wire frame guide slots 6 and the wire frame assembly protrusions 20 in the extended or locking position. When wire frame assembly 5 rotates outward (as shown in FIG. 10*a*) due to the insertion of roll paper products 10, wire frame 5 moves outward along wire frame guide slots 6. This causes wire frame protrusions 20 to extend outward from frame protrusion/opening 12 (as shown in FIG. 10*a*). When wire frame locking protrusions are fully extended, due to roll paper products 10 being loaded into carriage assembly 1, wire frame protrusions will rest on rear housing locking catch 19 when carriage assembly 1 is inserted into guide tracks 9 (shown in FIGS. 2 and 5). In this manner, carriage assembly 1 is held in the lower dispensing position 14 (as shown in FIGS. 6 and 7) until the exposed roll paper product 10 is depleted.

Figure 10B:
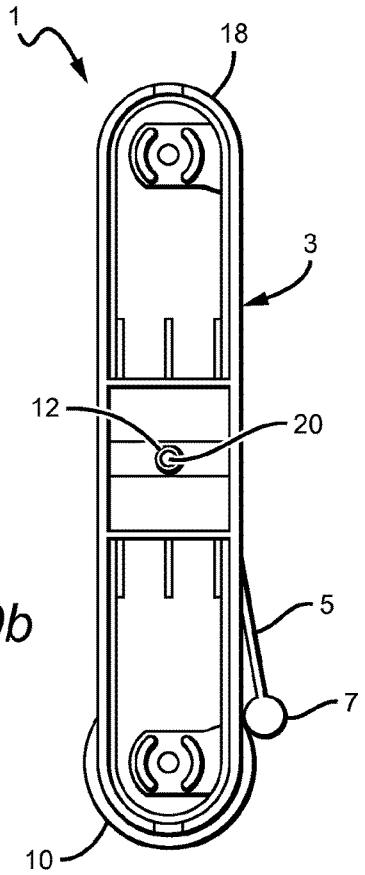
FIG. 10*b* is a side view of a carriage assembly with a nearly empty roll of paper product.
Figure 12:
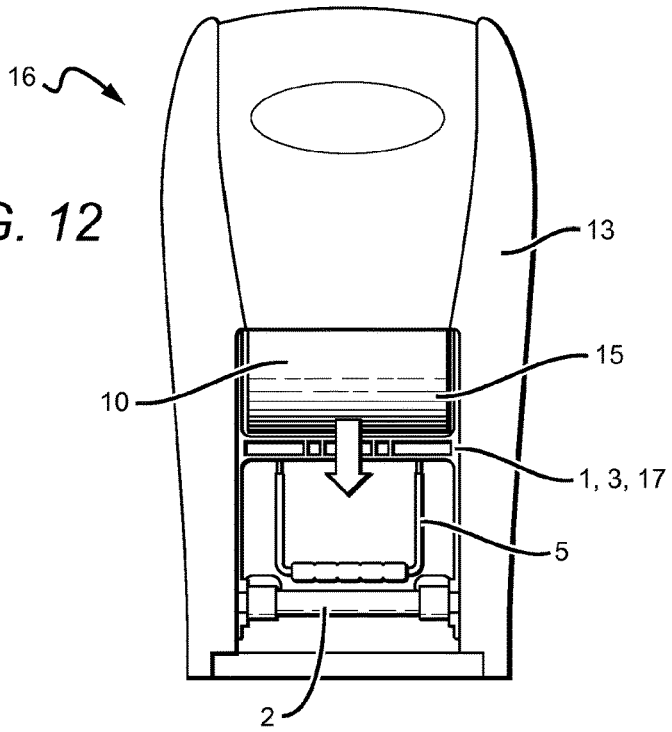
FIG. 12 is a front view of a dispenser showing a carriage assembly in the unlocked position and with paper product in the upper dispensing position.

FIG. 9*b* is a bottom view of the carriage assembly 1 showing the wire frame guide slots 6 and the wire frame assembly protrusions 20 in the retracted or unlocked position. When wire frame assembly 5 rotates inward (as shown in FIG. 10*b*), due to the depletion of roll paper products 10, wire frame 5 moves inward along wire frame guide slots 6, which causes wire frame protrusions 20 to retract inward from frame protrusion/opening 12 (as shown in FIG. 10*b*). When wire frame locking protrusions are fully retracted, due to the depletion of roll paper products 10, carriage assembly 1 will be allowed to drop past rear housing locking catch 19, thus presenting the upper dispensing position 15 in front of the opening of front cover 13 (as shown in FIG. 12). Carriage assembly 1 thus allows for the automatic advancement of the reserve roll once the primary roll has been depleted.

It is contemplated that guide slots 6 could have shapes other than those shown in FIGS. 9*a* and 9*b*. For example, slots 6 could be substantially linear and non-parallel, concave, convex, or even irregular. As used herein, "non-parallel" means the distance between opposing and corresponding positions along the slots vary throughout the lengths of slots.

FIG. 10*a* is a side view of the carriage assembly 1 showing protrusions 4 extending from vertical members 18. FIG. 10*a* also shows frame protrusion/opening 12 and wire frame assembly protrusions 20. Also shown is a full roll paper products 10, wire frame assembly 5 and wire frame rollers 7. Wire frame rollers 7 rotate as the roll paper products 10 rotate on spindle 2, thus reducing the amount of resistance (i.e., friction) transferred from the wire frame assembly 5 to the roll paper products 10. As wire frame assembly 5 is rotated outward due the insertion of roll paper products 10, wire frame assembly protrusions 20 is extended outward (shown in FIG. 9*a*) locking carriage assembly 1 above rear housing locking catch 19 (shown in FIG. 5). This allows for the dispensing of the roll paper products 10 held in lower dispensing position 14 (shown in FIG. 7).

FIG. 10*b* is a side view of the carriage assembly 1 showing protrusions 4 extending from vertical members 18. FIG. 10*b* also shows frame protrusion/opening 12 and wire frame assembly protrusions 20. Also shown is an empty roll paper products 10, wire frame assembly 5 and wire frame rollers 7. As wire frame assembly 5 is rotated inward due the depletion of roll paper products 10, wire frame assembly protrusions 20 are retracted inward (shown in FIG. 9*b*) releasing carriage assembly 1 from rear housing locking catch 19 (shown in FIG. 5). This allows for the dispensing of the roll paper products 10 from the upper dispensing position 15 (shown in FIG. 12).

FIG. 11 is a front section view of wire frame 5 in its normal state (i.e., resting state). Wire frame 5 has angles $\theta_1$ and $\theta_2$. When an outward force is exerted on wire frame vertical member 23, angles $\theta_1$ and $\theta_2$ are increased and wire frame assembly protrusions 20 will extend outward. When the force exerted on wire frame vertical member 23 is relieved, wire frame 5 will return to its normal state, reducing angles $\theta_1$ and $\theta_2$ and retracting wire frame assembly protrusions 20. Although angles $\theta_1$ and $\theta_2$ are shown as substantially similar, non-equal angles are also contemplated.

While wire frame 5 is shown to have a substantially round horizontal cross section in FIG. 11, other cross-sectional shapes are also contemplates. However, a round cross section helps to decrease rotational friction between wire frame 5 and carriage frame 3. As used herein, "wire" simply means an elongated member. The term wire is not intended to imply any particular material or cross-sectional shape. In some embodiments, the wire material has an elasticity sufficient to undergo the necessary expanding and contracting without substantial permanent deformation.

FIG. 12 is a front view of the dispenser assembly 16 showing carriage assembly 1 with upper dispensing position 15 in an accessible position and with the roll paper products 10 positioned for dispensing. Roll paper products 10 has already been depleted from the lower dispensing position 14, and wire frame assembly protrusions 20 have retracted, permitting carriage assembly 1 to drop down 52 cm. While dispenser assembly 16 is configured to have two dispensing positions (upper and lower), those of skill in the art will appreciate that a dispenser's tracks and housing size could be configured such that the reserve roll drops down into the same position as the primary roll.

Figure 13:
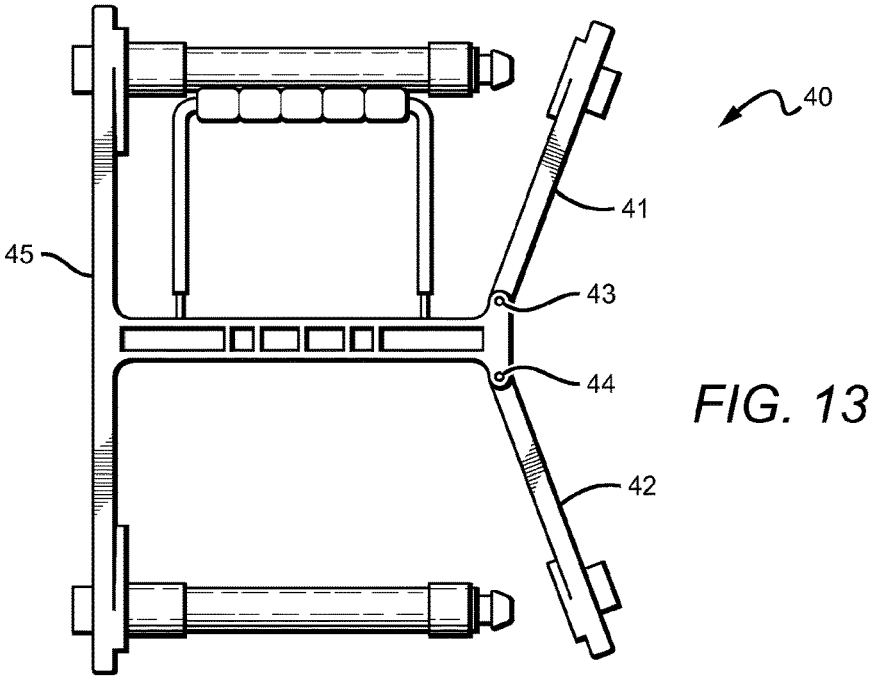
FIG. 13 is a perspective view of another embodiment of a carriage assembly that has two vertical members hingeably for loading rolls of paper product.

FIG. 13 shows a carriage assembly 40. Carriage assembly 40 is similar to carriage assembly 1 accept that assembly 40 has vertical members 41 and 42 hingeably coupled with frame 45 via couplings 43 and 44, respectively. Vertical members 41 and 42 can be rotated open to allow rolls of paper product to be loaded onto carriage assembly 40. Those of skill in the art will appreciate that other configurations of couplings can be used to allow vertical members 41 and 42 to open for receiving rolls of paper product.

Those of skill in the art will appreciate that a carriage assembly can be configured to hold three or more rolls of paper products. In such embodiments, the carriage assembly would require multiple wire frame assemblies and wire frame guides for holding the carriage in various positions. The inventive subject matter disclosed herein is not intended to be limited to two rolls of paper product per carriage assembly.

While the present subject matter specifically discloses dispensers for roll paper products, one of skill in the art will recognize that these inventive concepts can be equally applicable with nonabsorbent and/or non-paper rolls of material. As such, the inventive subject matter is not intended to be limited by the term "paper products." The advantage of the present invention is a simple automatic advancing mechanism for sequentially dispensing rolls of product, which can be applied to numerous kinds of rolled materials.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A dispenser for sequentially dispensing a plurality of paper product rolls, comprising:

a housing having a first track and a first catch;

a carriage assembly comprising (i) a frame, (ii) a first pair of spindle retainers that define a first axis, (iii) a first protrusion configured to releasably engage the first track, and (iv) a wire frame guide; and a wire frame assembly disposed in the wire frame guide and rotatably coupled with the frame such that the wire frame assembly rotates about a second axis;

wherein the wire frame guide comprises first and second noncontiguous slots within a wall of the frame wherein the first and second slots have a first set of points between which defines a first distance and a second set of points between which defines a second distance, wherein the first distance is different than the second distance;

wherein the first axis and the second axis are substantially non-perpendicular such that the wire frame assembly rests on an outmost winding of a paper product roll; and wherein the wire frame assembly and the wire frame guide are configured such that (i) the wire frame assembly is biased to rotate towards the first pair of spindle retainers that define the first axis and (ii) a first end of the wire frame assembly retracts axially inward from the frame to disengage the first catch when the wire frame assembly is rotated towards the first axis.

2. The dispenser of claim 1, further comprising a first spindle that fits between the first pair of spindle retainers and is configured to releasably engage a plurality of coreless tissue rolls.

3. The dispenser of claim 1, further comprising a second spindle that fits between the first pair of spindle retainers and is configured to releasably engage a plurality of reduced-core tissue rolls.

4. The dispenser of claim 1, wherein:

the housing further comprises a second track and a second catch;

the carriage assembly further comprises a second protrusion configured to releasably engage the second track; and the wire frame assembly has a second end that retracts axially inward from the frame to disengage the second catch when the wire frame assembly is rotated towards the first pair of spindle retainers that define the first axis.

5. A carriage assembly for automatically advancing roll paper products in a sequential dispenser, comprising:

a frame having (i) first and second pairs of spindle retainers configured to releasably engage first and second spindles, respectively;

(ii) first and second protrusions defining an axis and configured to releasably engage a first track and a second track, respectively; and (iii) a wire frame guide comprising first and second slots within a wall of the frame wherein the first and second slots have a first set of points between which defines a first distance and a second set of points between which defines a second distance, and wherein the first distance is different than the second distance;

a wire frame assembly comprising first and second ends, wherein the wire frame assembly is configured to rotatably couple with the frame and configured to fit within the first and second slots of the wire frame guide; and wherein the wire frame assembly and the wire frame guide are configured such that:

(i) the wire frame assembly is biased to rotate in a first direction radially towards the axis when disposed in the first and second slots;

(ii) the first and second ends of the wire frame assembly retract in an inward direction toward the frame when the wire frame assembly rotates in the first direction;

(iii) the wire frame assembly can rotate in a second direction radially away from the axis when disposed in the first and second slots; and (iv) the first and second ends of the wire frame assembly extend in an outward direction away from the frame when the wire frame assembly rotates in the second direction.

6. The carriage assembly of claim 5, wherein the frame is substantially symmetrical.

7. The carriage assembly of claim 5, wherein the first and second spindles are expandable and contractible.

8. The carriage assembly of claim 7, wherein the first and second spindles are configured to releasably engage a first roll paper product and a second roll paper product, respectively.

9. The carriage assembly of claim 8, wherein the first and second roll paper products are selected from the group consisting of cored, coreless, solid-core, and reduced core.

10. The carriage assembly of claim 5, further comprising third and fourth spindle retainers.

11. The carriage assembly of claim 5, further comprising third and fourth protrusions configured to engage the first and second tracks.

12. The carriage assembly of claim 5, wherein the first and second slots have a nonlinear shape.

13. The carriage assembly of claim 5, wherein the wire frame assembly has a circular horizontal cross section.

14. The carriage assembly of claim 5, wherein the first and second ends are configured to fit through, and rotatably couple with, first and second openings on the frame, respectively.

15. The carriage assembly of claim 14, wherein the first and second ends are configured to engage a catch.

16. The carriage assembly of claim 5, wherein the first direction comprises an inward direction with respect to the frame.

17. The carriage assembly of claim 5, further comprising a dispenser housing having first and second interior walls.

18. The carriage assembly of claim 17, further comprising the first and second tracks, wherein the first and second tracks are integrated into the first and second interior walls, respectively.

19. The carriage assembly of claim 18, further comprising a first catch and a second catch disposed in the first and second tracks, respectively.

20. The carriage assembly of claim 19, wherein the wire frame assembly comprises a material having sufficient elasticity to allow the first and second portions to expand into and be received by the first and second catches when the wire frame assembly is rotated in the second direction, without permanent deformation of the wire frame assembly.

* * * * *